US012678678B2

(12) United States Patent
Vincent

(10) Patent No.: US 12,678,678 B2
(45) Date of Patent: Jul. 14, 2026

(54) PORTABLE PADDLEPOST GAME

(71) Applicant: Roy Vincent, Coral Springs, FL (US)

(72) Inventor: Roy Vincent, Coral Springs, FL (US)

( * ) Notice: Subject to any disclaimer, the term of this patent is extended or adjusted under 35 U.S.C. 154(b) by 847 days.

(21) Appl. No.: 18/099,900

(22) Filed: Jan. 20, 2023

(65) Prior Publication Data

US 2024/0245965 A1 Jul. 25, 2024

(51) Int. Cl.

| | |
|---|---|
| ***A63B 63/08*** | (2006.01) |
| ***A63B 59/42*** | (2015.01) |
| ***A63B 67/00*** | (2006.01) |
| ***A63B 71/06*** | (2006.01) |
| ***A63B 102/08*** | (2015.01) |

(52) U.S. Cl.

CPC ..... *A63B 63/08* (2013.01); *A63B 59/42* (2015.10); *A63B 67/002* (2013.01); *A63B 71/06* (2013.01); *A63B 2102/08* (2015.10); *A63B 2210/50* (2013.01)

(58) Field of Classification Search

CPC ..... A63B 63/08; A63B 59/42; A63B 67/002; A63B 71/06; A63B 2102/08; A63B 2210/50; A63B 69/0097; A63B 71/0622; A63B 71/0669; A63B 2071/0625; A63B 63/00

See application file for complete search history.

(56) References Cited

U.S. PATENT DOCUMENTS

| | | | | |
|---|---|---|---|---|
| 3,908,992 A | | 9/1975 | Cunningham et al. | |
| 3,926,433 A | | 12/1975 | Jacques | |
| 3,945,641 A | | 3/1976 | Carbonero | |
| 4,473,227 A | * | 9/1984 | Klaus | A63B 63/00 273/DIG. 30 |
| 4,757,996 A | | 7/1988 | McNutt | |
| 4,834,392 A | | 5/1989 | Nixon | |
| 4,844,478 A | | 7/1989 | Kessler | |
| 4,979,754 A | | 12/1990 | Eisenhart | |
| 5,058,899 A | | 10/1991 | Jackson et al. | |
| 5,348,293 A | | 9/1994 | Smith | |
| 5,348,307 A | | 9/1994 | Duggan | |
| 5,630,589 A | | 5/1997 | Adie et al. | |
| 5,827,137 A | | 10/1998 | Ishino | |
| 6,375,585 B1 | * | 4/2002 | Driscoll | A63B 69/00 473/477 |
| 6,669,583 B1 | | 12/2003 | Deppen | |
| 6,945,885 B2 | | 9/2005 | Snider | |

(Continued)

FOREIGN PATENT DOCUMENTS

| | | | | |
|---|---|---|---|---|
| CA | 2944176 A1 | * | 4/2018 | A63B 67/06 |

OTHER PUBLICATIONS

Translation of CA 2944176 A1. (Year: 2018).*

*Primary Examiner* — Jeffrey S Vanderveen

(74) *Attorney, Agent, or Firm* — Doster Greene, LLC; Dinnatia Doster-Greene

(57) ABSTRACT

A paddle sport game includes a portable framework structure comprising a base, a vertical support structure connected to the base, and a horizontal crossbar connected to two vertical arms that form a volley area having a defined space. At least one player is positioned on one side of the framework and at least another player is positioned on the opposite side of the framework. The players using paddles volley a ball through the volley area with the objective being not to allow the ball to hit the ground or to hit the ball below the horizontal crossbar.

15 Claims, 14 Drawing Sheets

(56) References Cited

U.S. PATENT DOCUMENTS

| | | | | |
|---|---|---|---|---|
| 11,433,286 | B1 * | 9/2022 | Beye | A63B 63/008 |
| 2005/0134001 | A1 * | 6/2005 | Rowan | A63B 63/004 273/401 |
| 2006/0125184 | A1 * | 6/2006 | Benson | A63B 67/002 273/343 |
| 2011/0136594 | A1 * | 6/2011 | Orr | A63B 71/06 473/426 |
| 2015/0031480 | A1 * | 1/2015 | Kidd, III | A63B 63/00 473/478 |
| 2016/0303447 | A1 | 10/2016 | Digiacomo | |
| 2017/0021254 | A1 * | 1/2017 | Wolf | A63B 67/06 |
| 2023/0181983 | A1 * | 6/2023 | Dickerson | A63B 63/00 473/435 |

* cited by examiner

PORTABLE PADDLEPOST GAME

FIELD OF INVENTION

The present application relates to methods and devices for playing a game, and more particularly to a paddle sport game that includes a portable framework such that the game can be played outdoors and indoors.

BACKGROUND OF THE INVENTION

Paddle sports games, such as beach paddleball, are known in the art in which two or more players stand at a distance from each other and volley a ball between the players using paddles. Such games can be a source of entertainment, while developing and maintaining physical fitness, agility, and coordination, and also serve as a vehicle for promoting healthy competitiveness while building camaraderie. As people maintain a constant desire to learn to play new games that combine competitive objectives, a degree of skill, and camaraderie, the need persists for novel games, and the equipment associated with such games that facilitate their play.

SUMMARY OF THE INVENTION

The present invention may satisfy one or more of the above-mentioned desirable aspects. Other features and/or aspects may become apparent from the description which follows. The systems, methods and devices of the disclosure each have innovative aspects, no single one of which is indispensable or solely responsible for the desirable attributes disclosed herein. Without limiting the scope of the claims, some of the advantageous features will now be summarized.

The present invention of a portable paddle sport game is referred to herein as "a PaddlePost game" and includes a framework structure having a pair of vertical arms which form a defined space through which a ball is volleyed therebetween by at least two players using paddles and positioned on opposite sides of the framework structure. The PaddlePost game adapts and extends the elements of conventional beach paddleball by providing a physical framework structure to broaden the physical, spatial and dynamic dimensions of the game, and the manner of play. The use of the physical framework structure is a central element of the game, thus necessitating a change in the manner in which conventional paddlesport games are played, and consequently differentiating it from other paddle sport games.

The PaddlePost game is played similarly to the game of beach paddleball in that it can be played by two or more players using similar-type wooden paddles and a small, soft rubber ball. As in beach paddleball, the goal of the game is for the players to volley the ball with their paddles so that the ball is returned to the opposing player(s) who will in turn return it in a similar manner without the ball falling to the ground. The main difference between the two sports is that with the PaddlePost game is that the players on either side of the framework structure must volley the ball between two vertical arms. The framework includes two vertical arms temporarily attached to a crossbar elevated on a single pole to resemble a goal post having a U-shaped in one embodiment. In some embodiments, the U-shaped goal post can be configured to be, similar in shape, but not having the same dimensions and composition to a goal post used in American football. The purpose of the space defined by the two vertical arms is to challenge the player's accuracy, resourcefulness, agility and consistency to continually return the ball to the opposing player through the defined space of the two vertical arms. The PaddlePost game can be played outdoors and indoors.

In one embodiment, a kit for a paddle sport game includes a framework having a foldable base with a single pole extending therefrom and attached to a horizontal crossbar structure adapted to be detachably coupled with two vertical arms. One or more paddles and a ball can be optionally included in the kit. The paddles and ball used can be similar to those used in other paddle sports, such as beach paddleball. Such conventional paddles are normally constructed of hard plywood, approximately 15-17 inches long, 9 inches wide, and having a ⅜ inch thickness. The hollow ball is typically constructed of rubber and is approximately 2-4 inches in diameter.

Various embodiments provide a new and novel game which is inexpensive to manufacture, may be easily and quickly assembled for use and disassembled for transportation and storage. The apparatus can be made of suitable materials which provide desirable characteristics to allow the apparatus to be repeatedly used with minimal damage, and allow for ease of storage or transportation.

In the following description, certain aspects and embodiments will become evident. It should be understood that the invention, in its broadest sense, could be practiced without having one or more features of these aspects and embodiments. It should also be understood that these aspects are merely exemplary and explanatory and are not restrictive of the invention.

The skilled artisan will understand that the drawings described below are for illustrative purposes only. The drawings are not intended to limit the scope of the present teachings in any way.

DETAILED DESCRIPTION OF THE EMBODIMENT(S)

Embodiments of this disclosure encompass methods and devices for playing a portable PaddlePost game. For convenience in transporting and assembly, the PaddlePost game can include four pieces of lightweight % inch diameter PVC piping, and a foldable metal base that can be quickly assembled by simply fitting the components together. No tools are required for assembly. The PaddlePost game can be played either outdoors on a sandy beach, lawn, or paved surface. The PaddlePost game can also be played indoors in a gymnasium or wherever there is a hard level surface.

Figure 1:
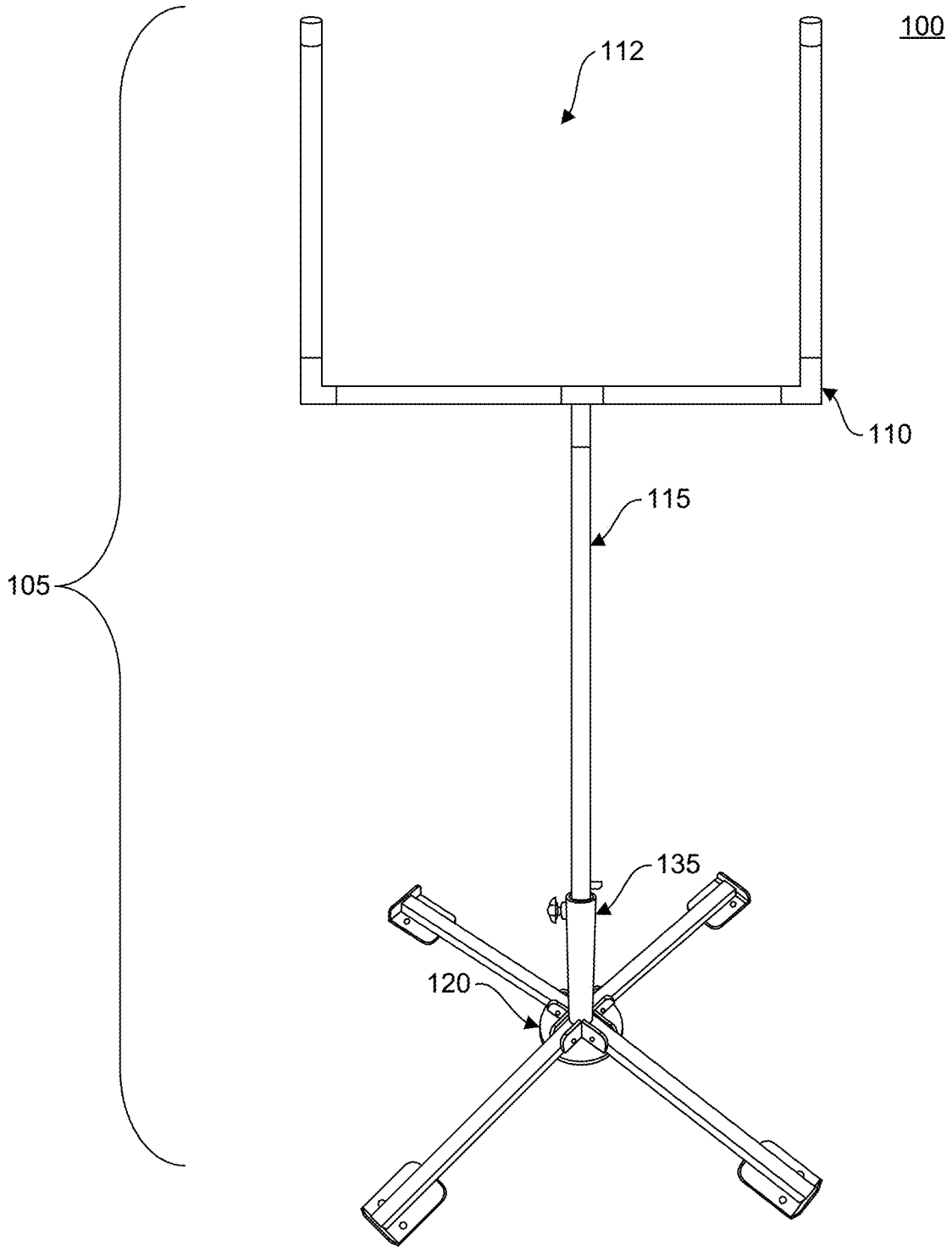
FIG. 1 is a perspective view of a PaddlePost game apparatus in accordance with the present teachings.

FIG. 1 illustrates a perspective view of one embodiment of the PaddlePost game. The apparatus 100 primarily comprises a framework 105. In the embodiment shown in FIG. 1, the framework 105 forms a goal post structure having a U-shaped cross bar assembly 110 and a vertical support structure 115 detachably connected to a base 120. The U-shaped cross bar assembly 110 forms a volley area 112 having a defined shape shown in FIG. 1. In embodiments, the defined area formed by the volley areal 12 is completely void between the vertical support structures 115. In other embodiments the U-shaped cross bar assembly 110 may have other shapes or appearances. In general, the framework 105 can be constructed of a light-weight material that can be easily assembled and disassembled, making it portable and convenient for carrying and playing in different venues.

Figure 2A:
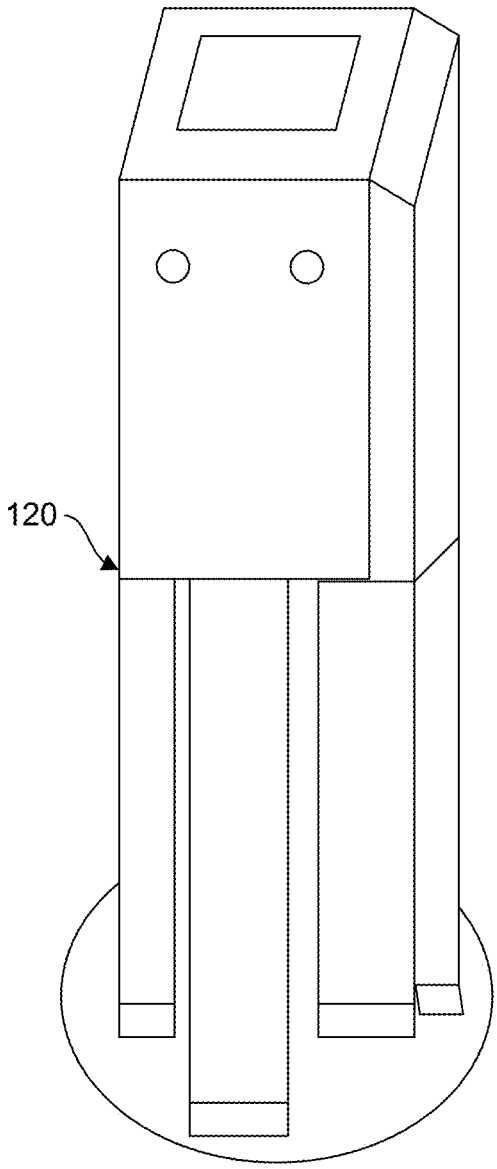
FIGS. 2A-2E illustrate components of the PaddlePost game apparatus of FIG. 1 in accordance with the present teachings.
Figure 2B:
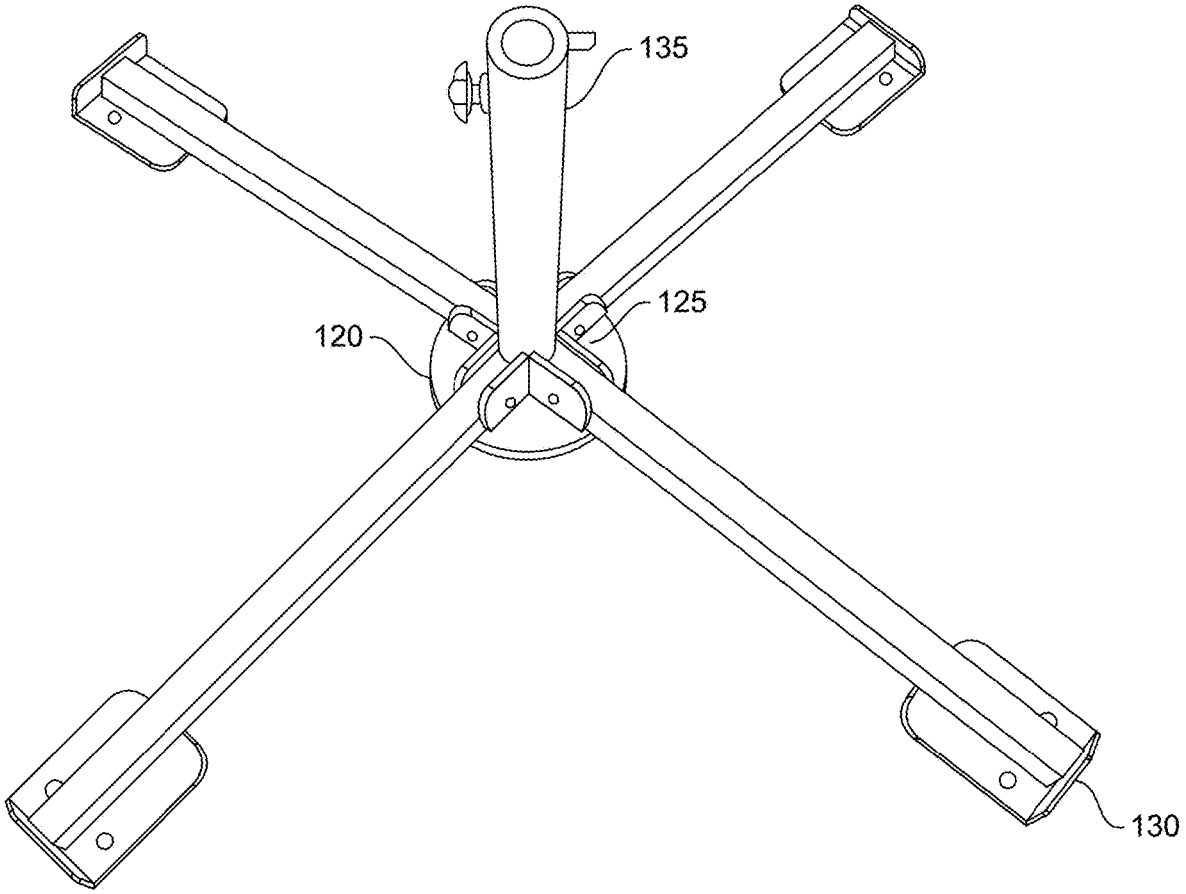

As depicted in the example of FIGS. 2A-2B, the base 120 can be a foldable base to provide a stable platform on which to support the associated vertical and horizontal structures. The base 120 can be used outdoors in sand or soil, or indoors on any flat surface. The components of the base 120 can be made of various materials, such as metal or plastic. In this embodiment, a center mating unit 125 joins four balance legs 130 to a lower vertical support structure 115. Each balance leg 130 is connected to the center mating unit 125 and is configured to extend away from the center mating unit 125 at approximately 90-degree angles from the other balance legs 130. The balance legs and the center mating unit 125 form a"+" to provide uniform directional support for the U-shaped cross bar assembly 110. In other embodiments the base can form a square, rectangle, triangle or other shapes that can provide similar stability for the framework 105.

The base 120 of the framework 105 is intended to reside on the ground or similar flat surface and support the connected vertical and horizontal structures. Accordingly, the lower vertical support structure 135 is connected to the center mating unit 125 to and extend vertically away from the ground.

Figure 2C:
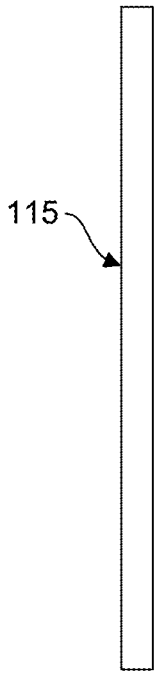

In the embodiment of the present invention shown in FIG. 1, the lower vertical structure 135 in FIG. 2B and an upper vertical structure 115 in FIG. 2C join to form the vertical structure as shown. For example, the upper vertical structure 115 can be inserted into a hole provided at the top of the lower vertical structure 135 and secured by any attachment mechanism, such as screws. The upper vertical structure 115 for use with a game consistent with the present description can be configured with a variety of variations. In some embodiments, the upper vertical structure 115 can be configured having a fixed length. In one example, the upper vertical structure 115 is a PVC pipe having a diameter of approximately % inch and a length of approximately 40 inches-60 inches, preferably 50 inches. In other embodiments, the upper vertical structure 115 can include a height adjustable pole, which can be beneficial for allowing persons of different ages to adjust the length of the pole for their use or detachable interchangeable poles.

Figure 2D:
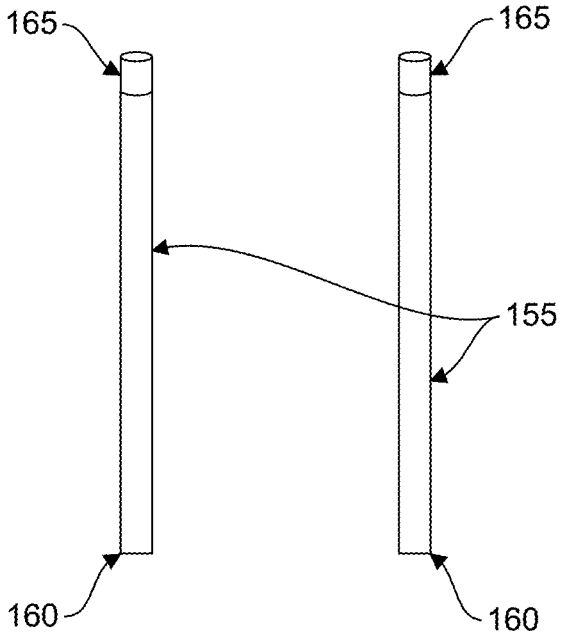
Figure 2E:
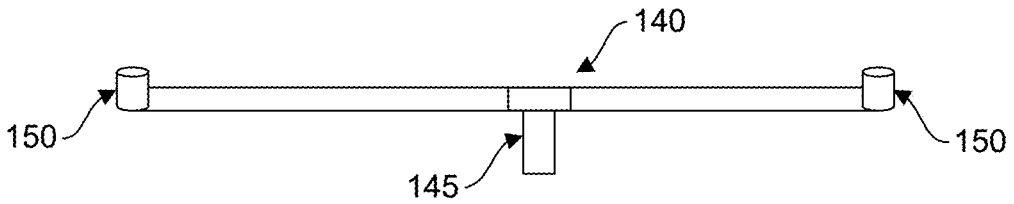

Coupled to the top of the upper vertical structure 115 is a U-shaped assembly 110 as shown in FIG. 1. The U-shaped assembly 110 includes a horizontal crossbar 140 shown in FIG. 2E. In one example, the crossbar 140 is a PVC pipe having a diameter of approximately % inch and a length of approximately 42 inches. The crossbar 140 can include approximately at its midpoint a T-connector 145 configured to connect to the upper vertical structure 115. The crossbar 140 may have at each end a 90 degree elbow connector 150 for insertion of vertical arms 155, shown in FIG. 2D, so that may be easily attached or removed. The vertical arms 155 may be attached to the crossbar 140 in any known acceptable manner. Connecting the vertical arms 155 to the crossbar 140 forms the volley area 112 having a defined shape shown in FIG. 1. In embodiments, the defined area formed by the volley area 112 is completely void between the vertical support structures 115 and the crossbar 140. The vertical arms 155 may have an open end 160 and a closed end topped with cap 165. The open end 160 of each vertical arm can be inserted into the open ends of the elbow connector 150 so that the cap 160 is positioned on top. In one example, each vertical arm 155 is a PVC pipe having a diameter of approximately % inch and a length of approximately 21 inches.

Figure 3A:
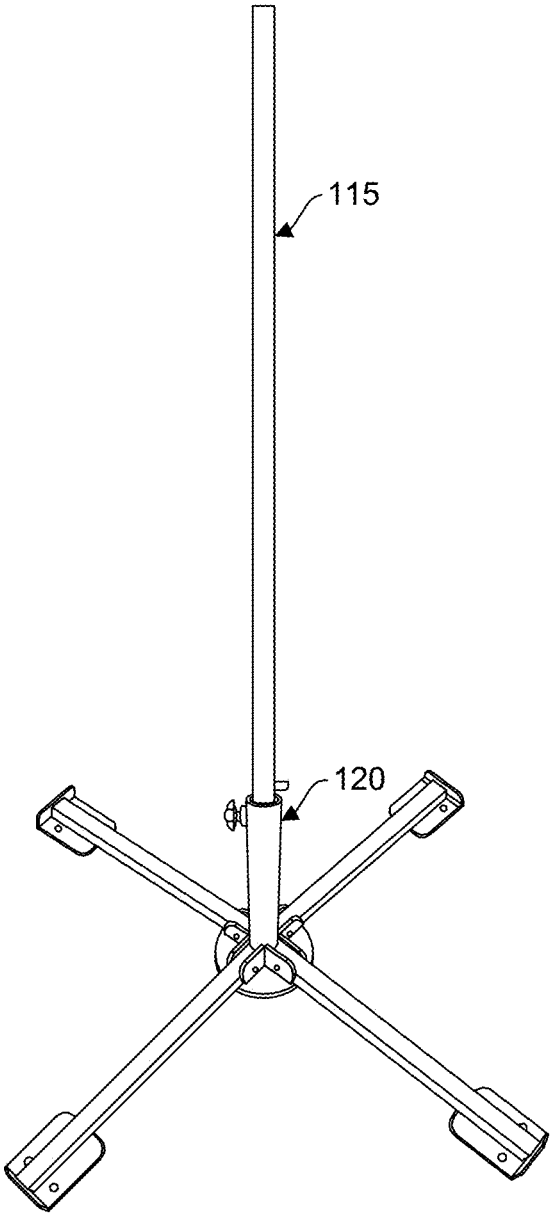
FIGS. 3A-3C illustrate a method of assembling the components of the PaddlePost game apparatus of FIG. 1 in accordance with the present teachings.
Figure 3B:
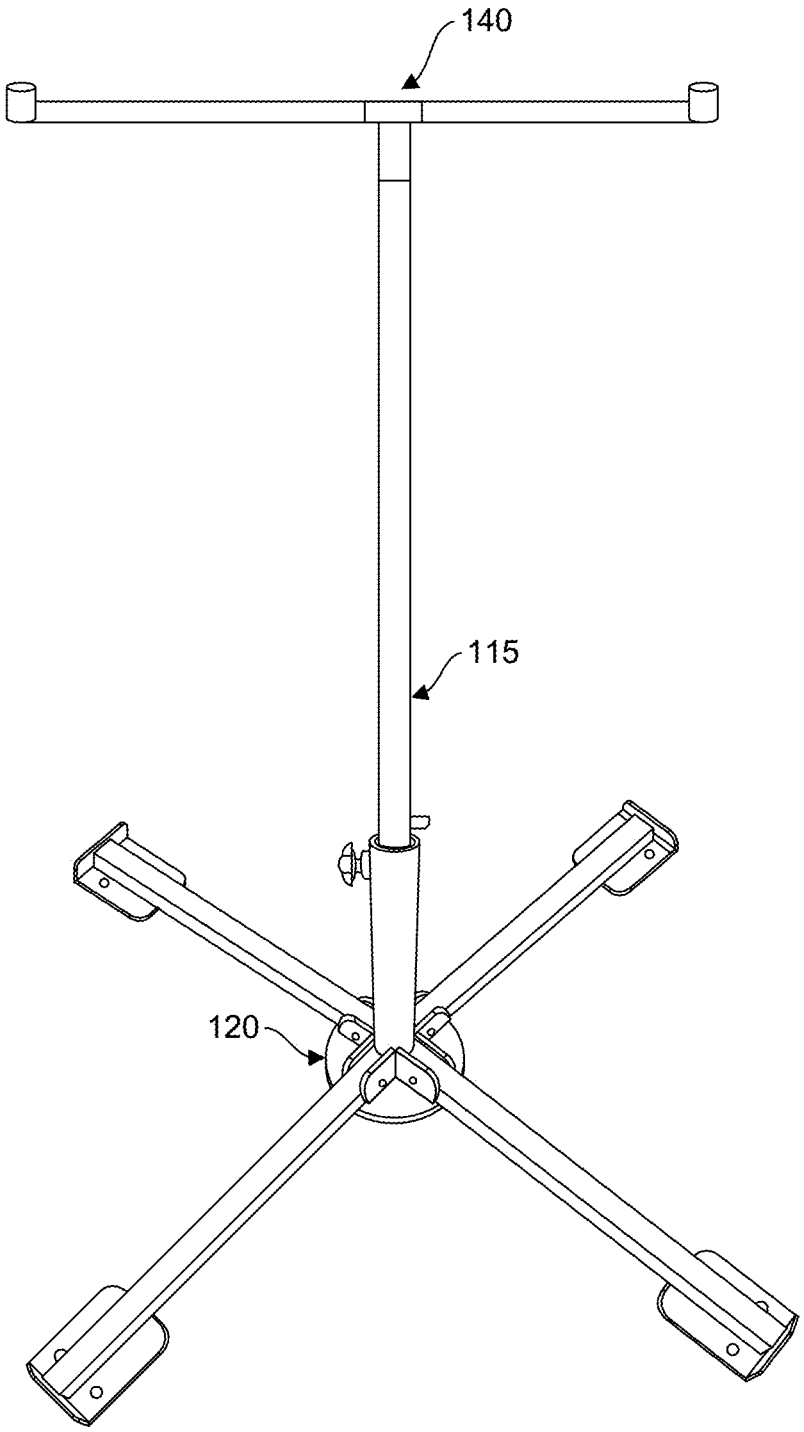
Figure 3C:
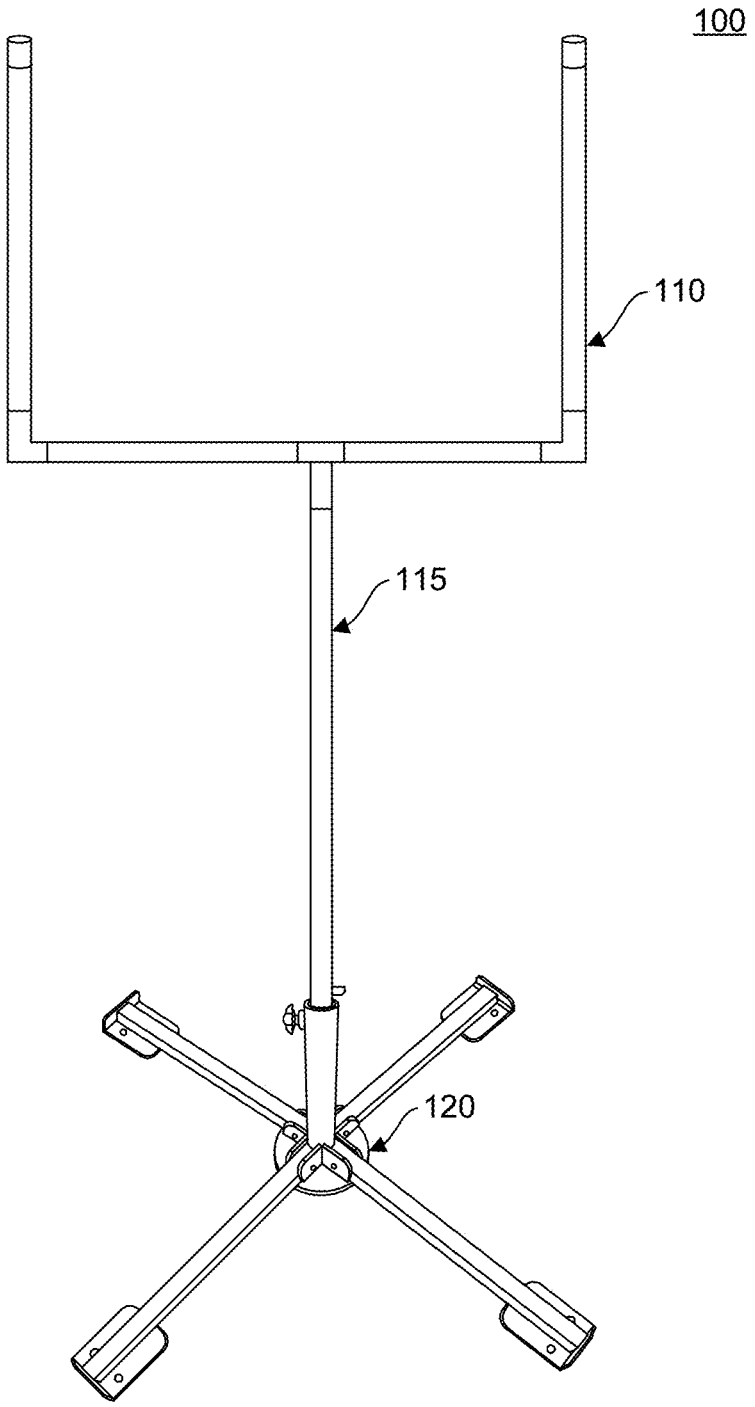

FIGS. 3A-3C illustrate steps of assembling the PaddlePost apparatus 100. Initially, in FIG. 3A, unfold the base 120 by simply pulling each of the four legs 130 downward, as shown in FIG. 2B, and insert the upper vertical support structure 115 into the hole at the top of the lower vertical support structure 135 of the base 120. Then, in FIG. 3B, attach the crossbar 140 to the upper vertical support structure 115 by inserting the upper vertical support structure 115 into the T-connector 145 on the crossbar 140. Finally, in FIG. 3C, attach both vertical arms 155 to the crossbar 140 by fitting them into the elbow connectors 150 provided on the crossbar 140. After assembly, according to one embodiment, the pair of vertical arms 155 connected with the crossbar 140 should resemble the U-shaped assembly 110. After playing the PaddlePost game, the base 120 can be folded by pulling each of the four legs horizontally outward (separately), and then pushing them upward against the lower vertical support structure 135, as shown in FIG. 2A.

While embodiments of the PaddlePost apparatus 100 is mainly described herein as consisting of separate components that are assembled together by the user of the game, the PaddlePost apparatus 100 can be manufactured as a single unit, that is completely foldable and adjustable. In a single unit embodiment, the PaddlePost apparatus 100 can be unfolded for use wherein the lower vertical support structure 135 of the base 120 houses the upper vertical support structure 115 such that the upper vertical support structure 115 is adjustable in a telescopic manner and extends from the base 120. The crossbar 140 is rotatably attached by a connection mechanism, such as a joint hinge, to the upper vertical support structure 115. The crossbar 140 can be rotated horizontally relative to the upper vertical support structure 115 at the T-connector 145 and locked into the horizontal position. The joint hinge can be locked in at 90 degrees relative to the upper vertical support structure 115. Both vertical arms 155 are rotatably attached by joint hinges to the crossbar 140. The vertical arms can be rotated relative vertically to the crossbar 140 and locked in a vertical position using the joint hinges. After use when it is desired to return the PaddlePost apparatus 100 to the folded position, the steps can simply be reversed.

Figure 4A:
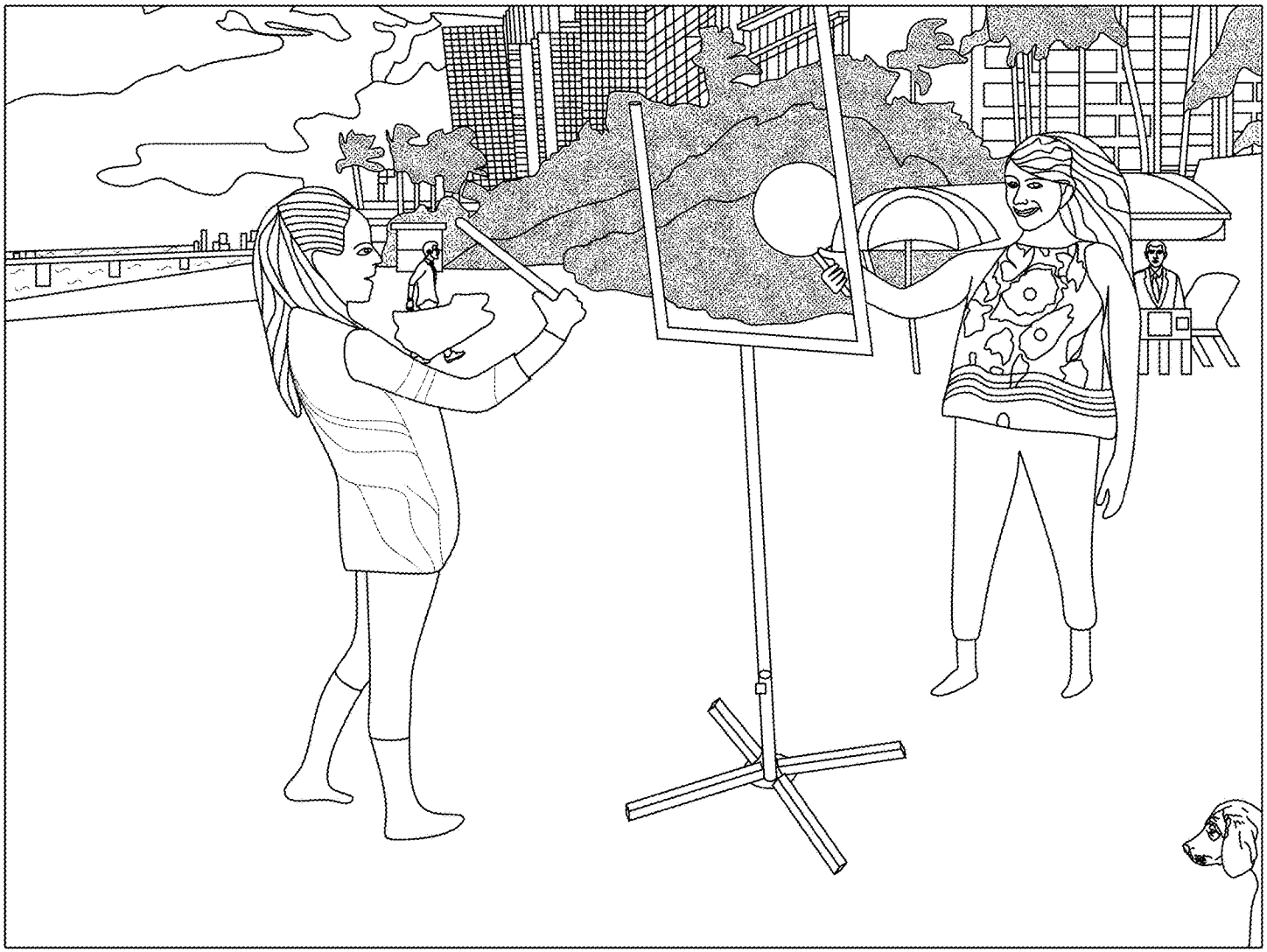
FIGS. 4A-4B demonstrate players playing the PaddlePost game and the equipment associated with the game in accordance with the present teachings.
Figure 4B:
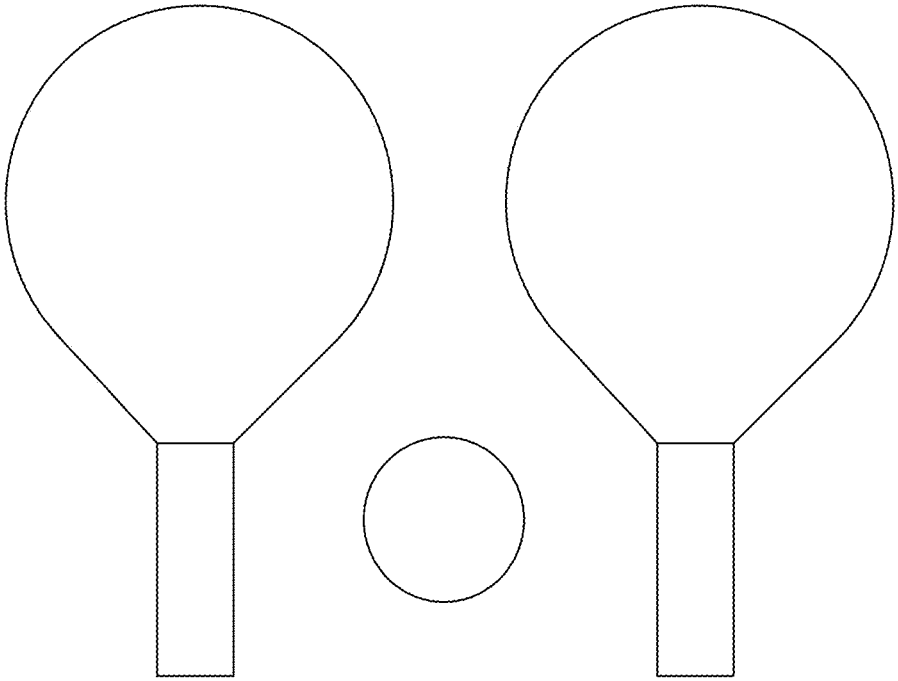

As illustrated in FIG. 4A, the present application relates to methods and devices for playing a game, and more particularly to a portable paddle sport game that uses a framework structure including two vertical arms 155 which form a defined space through which a ball is volleyed therebetween. As shown in FIG. 4B, the paddles and ball used can be similar to those used in other paddle sports, such as beach paddleball. Such conventional paddles are normally constructed of hard plywood, approximately 15-17 inches long, 9 inches wide, and having a ⅜ inch thickness. The hollow ball is typically constructed of rubber and is approximately 2-4 inches in diameter. The PaddlePost game described herein adapts and extends the elements of conventional beach paddleball by providing a physical framework to broaden the physical, spatial and dynamic dimensions of the game, and the manner of play. The use of the physical framework is a central element of the game, thus necessitating a change in the manner in which conventional paddle sport games are played, and consequently differentiating it from other paddle sport games.

For instance, while playing the PaddlePost game, volleying the ball between the vertical arms 155 provides many benefits to the players, such as physical fitness, agility, and hand-eye coordination. The PaddlePost game can also enhance the player's spatial awareness, which is a complex cognitive skill. Spatial awareness is important for a person's depth perception and relates to their physical understanding of distance and the ability to interact with the environment around the person.

The game may be played in various ways but a set of rules is now set out below by way of example:

During a non-competitive play mode, for purposes of simplicity, the PaddlePost game can be enjoyed without adhering to any scoring rules except making sure each player makes every effort to return the ball within the vertical arms 155 of the framework 105. Players must serve the ball under-handed but can return it under-handed or over-handed. If, during play, the ball falls to the ground or is returned below the horizontal crossbar 140, or to the outsides of the two vertical arms 155, then the opposing player will restart play by serving the ball. Returning the ball high over the two vertical arms 155 is acceptable as long as it is judged within the two vertical arms 155. Keeping score is optional since the objective is to have fun, keep the ball in play for as long as possible, and maximize the agility and exercise opportunities for the players.

The game does not require any boundaries so that the ball can be returned from any distance or position from behind the post, as long as it passes through the two vertical arms 155. This is also meant to keep the game fluid and compensate for the player's abilities.

During a competitive play mode, players who are interested in playing competitively must still use the rules described above for non-competitive play. However, they can adapt the rules of beach paddleball with regard to keeping score. For the PaddlePost game, they must volley the ball between the two vertical arms 155, and play to a determined score, normally 7, 11 or 21 points, and the winner must win by 2 points. Also, since there are no marked boundaries, points can only be awarded to the opposing player if the ball is not returned between the two vertical arms 155, or if it falls to the ground.

Players must serve the ball under-handed but can return it under-handed or over-handed. If, during play the ball falls to the ground or is returned below the horizontal crossbar 140, or to the outsides of the two vertical arms 155, then the opposing player is awarded 1 point and the chance to continue play by serving the ball.

Figure 5A:
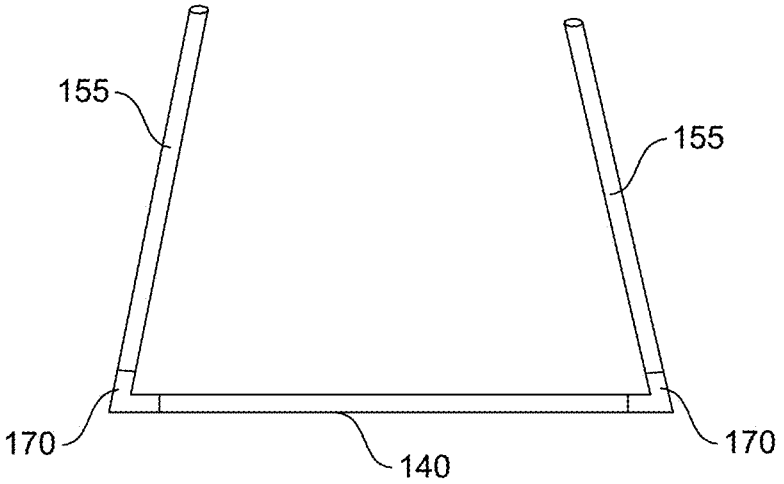
FIGS. 5A-5B illustrate an embodiment wherein the vertical arms are adjustable to various positions in accordance with the present teachings.
Figure 5B:
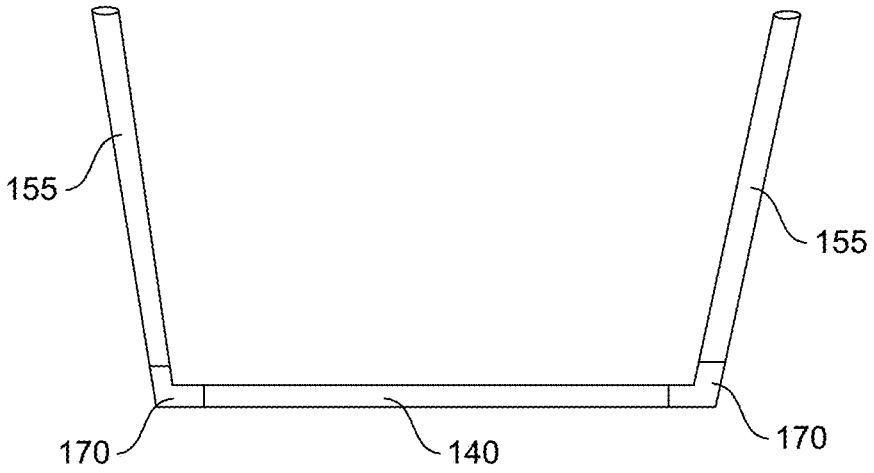

In an additional embodiment, as shown in FIGS. 5A-5B, the PaddlePost game further comprises adjustable vertical arms 155 which can be repositioned to form various shapes to challenge the players to volley within an area having a predefined shape. In such an embodiment, the crossbar 140 may have at each end an adjustable elbow connector 170 for insertion of vertical arms 155 so that they may be easily attached, positioned and locked at various angles. In the example of FIG. 5A, the vertical arms 155 can be positioned to form a triangular shape. The vertical arms 155 can be repositioned from the triangular shape in FIG. 5A to form a trapezoidal shape as shown in FIG. 5B or the U-shape shown in FIG. 1. Thus, the vertical arms 155 can be adjusted relative to the crossbar 140.

Figure 6:
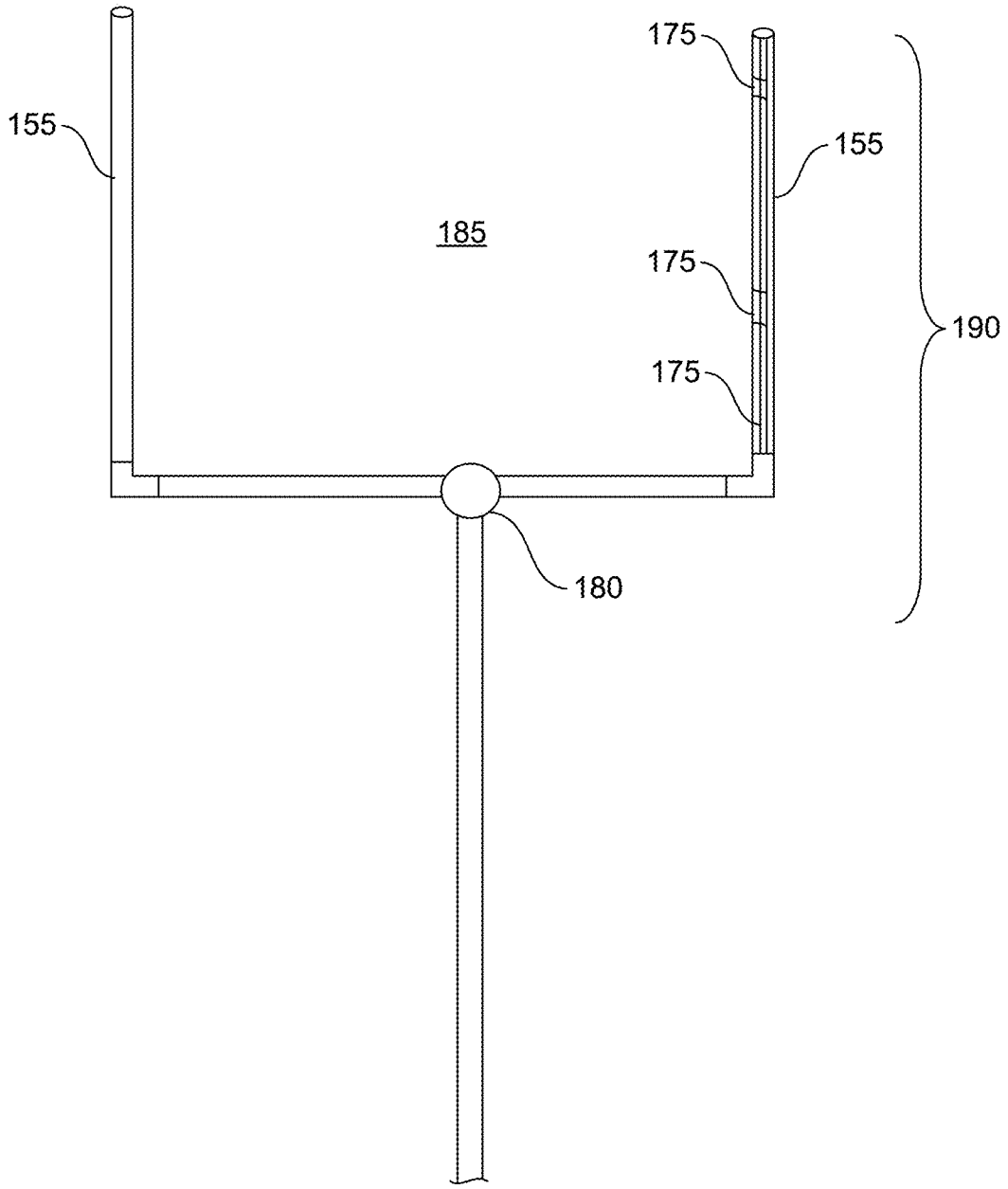
FIG. 6 illustrates an electronic scoring mechanism in accordance with the present teachings.

In a further embodiment illustrated in FIG. 6, the PaddlePost game further comprises an electronic scoring mechanism 190 to further challenge the players and enhance the benefits derived from volleying the ball between the vertical arms 155. The scoring mechanism 190 can enhance the accuracy of the players by awarding the players points when the ball is volleyed within the defined space of the vertical arms 155. The scoring mechanism 190 can include one or more sensors 175 included within or positioned along the exterior surface of the vertical arm 155 and a digital counter 180 in communication with the sensors, which is used to keep track of each player's or team's scores. The sensors 175 can be used to detect when the ball passes through a detection area 185 defined by the vertical arms 155 from a particular direction, which is indicative of the ball being volleyed from a particular player or team. The sensor can be configured to detect or sense the approach or presence and direction of nearby objects. For example, the sensor may be a proximity sensor, a directional sensor, or a motion sensor.

The electronic scoring mechanism 190 can include electrical circuitry and a power source. The power source can, for example, be at least one battery (rechargeable or non-rechargeable) and/or at least one solar cell to provide power to the digital counter 180, sensors 175, electrical circuitry, and possibly other components. Furthermore, the electronic scoring mechanism 190 can include a processor and a storage medium. The processor, which can be a microprocessor or controller, controls the operation of the electronic scoring mechanism 190. The storage device stores the sensor data 175. In one embodiment, the digital counter 180 and the sensors 175 can be included in one or more of the vertical arms 155 as an integral component. In another embodiment, the digital counter 180 and the sensors 175 can be separate components in wireless or wired communication with each other.

Aspects of the present disclosure have been described in detail with reference to the illustrated embodiments; those skilled in the art will recognize, however, that many modifications may be made thereto without departing from the scope of the present disclosure. The present disclosure is not limited to the precise construction and compositions disclosed herein; any and all modifications, changes, and variations apparent from the foregoing descriptions are within the scope of the disclosure as defined by the appended claims. Moreover, the present concepts expressly include any and all combinations and sub-combinations of the preceding elements and features.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments described herein can be embodied within a form that does not provide all of the features and benefits set forth herein, as some features can be used or practiced separately from others. All changes that come within the meaning and range of equivalency of the claims are to be embraced within their scope.

What is claimed is:

1. A method of playing a portable gaming apparatus, the method comprising:

placing a framework on a surface, wherein the framework comprises:

a base;

a vertical support structure connected to the base;

a horizontal structure coupled to the vertical structure apart from the base;

a pair of vertical arms detachably attached to the horizontal structure and defining a volley area having a defined shape, wherein the volley area is completely void between the pair of vertical arms;

wherein the pair of vertical arms comprises adjustable arms configured to adjust to define differing configurations;

wherein the adjustable arms are configured to be repositionable to define the differing configurations including a triangular shape, a trapezoidal shape, and a U-shape;

providing a plurality of paddles disposed on opposite sides of the volley area;

volleying back and forth a ball in an alternating manner through the volley area upon impact by at least one of the paddles;

defining, via at least one sensor comprised within to the pair of vertical arms, a detection area within the volley area;

detecting, by the at least one sensor, an entry of the ball into the detection area during volleying;

transmitting sensor data from the at least one sensor to a counter in communication therewith; and calculating, via the counter, a score in response to the at least one sensor detecting the entry of the ball into the detection area.

2. The method of claim 1, wherein the base comprises a foldable base including multiple supporting legs.

3. The method of claim 1, wherein the vertical support structure comprises an adjustable vertical support structure.

4. The method of claim 1, wherein the portable gaming apparatus is configured for use indoors and outdoors and the portable gaming apparatus constructed of a light-weight material for easy assembly and disassembly.

5. The portable gaming apparatus of claim 1, wherein the vertical support structure, the horizontal structure, and the pair of vertical arms are connected by a plurality of pivotally adjustable joints configured to permit the apparatus to transition between a deployed configuration and a compact, folded configuration without disassembly.

6. A portable gaming apparatus comprising:

a framework on a surface, wherein the framework comprises:

a base;

a vertical support structure connected to the base;

a horizontal structure coupled to the vertical structure apart from the base;

a pair of vertical arms detachably attached to the horizontal structure and defining a volley area having a defined shape, wherein the volley area is completely void between the pair of vertical arms;

wherein the pair of vertical arms comprises adjustable arms configured to adjust to define differing configurations;

wherein the adjustable arms are configured to be repositionable to define the differing configurations including a triangular shape, a trapezoidal shape, and a U-shape;

a plurality of paddles disposed on opposing sides of the volley area;

a ball configured to be volleyed back and forth in an alternating manner through the volley area upon impact by at least one of the paddles; and wherein the pair of vertical arms comprises at least one sensor configured to define a detection area within the volley area, detect an entry of the ball into the detection area, and transmit sensor data to a counter in communication with the at least one sensor, the counter configured to calculate a score in response to the at least one sensor detecting the entry of the ball into the detection area during volleying.

7. The portable gaming apparatus of claim 6, wherein the base comprises a foldable base including multiple supporting legs.

8. The portable gaming apparatus of claim 6, wherein the horizontal structure is a crossbar.

9. The portable gaming apparatus of claim 6, wherein each of the vertical arms is configured to couple with the horizontal structure by an elbow connector.

10. The portable gaming apparatus of claim 6, wherein the vertical arms couple with the horizontal structure to define the U-shape.

11. The portable gaming apparatus of claim 6, wherein the vertical support structure comprises an adjustable vertical support structure.

12. The portable gaming apparatus of claim 6, wherein each of the vertical arms is configured to couple with the horizontal structure by an adjustable angle connector.

13. The portable gaming apparatus of claim 6, wherein the portable gaming apparatus is configured for use indoors and outdoors and the portable gaming apparatus constructed of a light-weight material for easy assembly and disassembly.

14. The portable gaming apparatus of claim 6, wherein the vertical support structure, the horizontal structure, and the pair of vertical arms are connected by a plurality of pivotally adjustable joints configured to permit the apparatus to transition between a deployed configuration and a compact, folded configuration without disassembly.

15. A portable gaming apparatus comprising:

a framework on a surface, wherein the framework comprises:

a base;

a vertical support structure connected to the base;

a horizontal structure coupled to the vertical structure apart from the base;

a pair of vertical arms attached to the horizontal structure and defining a volley area having a defined shape, wherein the volley area is completely void between the pair of vertical arms;

wherein the pair of vertical arms comprises adjustable arms configured to adjust to define differing configurations;

wherein the adjustable arms are configured to be repositionable to define the differing configurations including a triangular shape, a trapezoidal shape, and a U-shape;

a plurality of paddles disposed on opposing sides of the volley area;

a ball configured to be volleyed back and forth in an alternating manner through the volley area upon impact by at least one of the paddles;

wherein the pair of vertical arms comprises at least one sensor configured to define a detection area within the volley area, detect an entry of the ball into the detection area, and transmit sensor data to a counter in communication with the at least one sensor, the counter configured to calculate a score in response to the at least one sensor detecting the entry of the ball into the detection area during volleying; and wherein the vertical support structure, the horizontal structure, and the pair of vertical arms are connected as a single unit by a plurality of pivotally adjustable joints configured to permit the apparatus to transition between a deployed configuration and a compact, folded configuration.

* * * * *